US005371662A

United States Patent [19]

Shen-Ko

[11] Patent Number: 5,371,662

[45] Date of Patent: Dec. 6, 1994

[54] MOVEMENT-CONTROLLED LIGHT EMITTING DEVICE

[76] Inventor: Tseng Shen-Ko, No. 28, Lane 41, Chyau-Dong Street, Shih-Chih Jenn, Taipei Hsien, Taiwan, Prov. of China

[21] Appl. No.: 103,482

[22] Filed: Aug. 6, 1993

[51] Int. Cl.[5] ..... F21V 23/00

[52] U.S. Cl. ..... 362/276; 362/103; 362/802; 36/137; 200/61.48; 200/244

[58] Field of Search ..... 362/103, 190, 276, 394, 362/802; 36/137, 139; 200/61.45 R, 61.48, 61.51, 61.52, 239, 244, 245, 246; 340/573

[56] References Cited

U.S. PATENT DOCUMENTS

| | | | |
|---|---|---|---|
| 1,650,968 | 11/1927 | Tedeschi | 200/61.52 |
| 1,651,414 | 12/1927 | Settegast | 200/244 |
| 2,484,159 | 10/1949 | Flynn, Jr. | 362/802 |
| 2,572,760 | 10/1951 | Rikelman | 362/103 |
| 2,765,377 | 10/1956 | Buchmann | 200/244 |
| 3,073,922 | 1/1963 | Miller | 200/61.48 |
| 4,284,862 | 8/1981 | Overman et al. | 200/61.45 R |
| 4,412,205 | 10/1983 | Von Kemenczky | 36/137 |
| 4,848,009 | 7/1989 | Rodgers | 36/137 |

FOREIGN PATENT DOCUMENTS

| | | | |
|---|---|---|---|
| 428475 | 5/1991 | European Pat. Off. | 200/244 |
| 634413 | 2/1928 | France | 200/61.51 |

*Primary Examiner*—Ira S. Lazarus
*Assistant Examiner*—Alan B. Cariaso
*Attorney, Agent, or Firm*—Ostrolenk, Faber, Gerb & Soffen

[57] ABSTRACT

A movement-controlled light emitting device includes a conductive swivel device rotatably fastened inside a casing mounted on a sports shoe and oscillated to intermittently connect the two opposite ends of a light emitting circuit as the shoe is moved, causing the light emitting element of the light emitting circuit to emit light intermittently.

5 Claims, 4 Drawing Sheets

MOVEMENT-CONTROLLED LIGHT EMITTING DEVICE

BACKGROUND OF THE INVENTION

The present invention relates to a light emitting device adapted to be installed in a sports shoe to emit light as the shoe is moved.

Various sports shoes have been disclosed having special functions. For example, sports shoes with step counters or light emitting devices are known, and widely accepted by people of all ages. A normal light emitting sports shoe generally includes a pressure switch on the sole and a light emitting element connected to an electronic battery cell through the pressure switch. As the sports shoe is put on the foot and stepped on the ground, the pressure switch is switched on to turn on the light emitting element. This light emitting device consumes a large amount of the electric power supply because the pressure switch is constantly switched on when the user stands still. Further, the structure of the light emitting device is complicated to install because the pressure switch must be fastened to the sole.

SUMMARY OF THE INVENTION

The present invention eliminates the aforementioned drawbacks. It is therefore an object of the present invention to provide a light emitting device for sports shoes which emits light only when it is moved. It is another object of the present invention to provide a light emitting device which can be conveniently fastened to a sports shoe at any desired location. According to the preferred embodiment of the present invention, a conductive swivel device is installed in a casing and oscillated to electrically connect the two opposite metal contacts of the electric circuit, which includes a light emitting element and an electronic battery cell, as the casing is moved by the sports shoe. Thus, the light emitting element emits light intermittently as the sports shoe is moved by the foot of the user.

DETAILED DESCRIPTION OF THE PREFERRED EMBODIMENT

Figure 1:
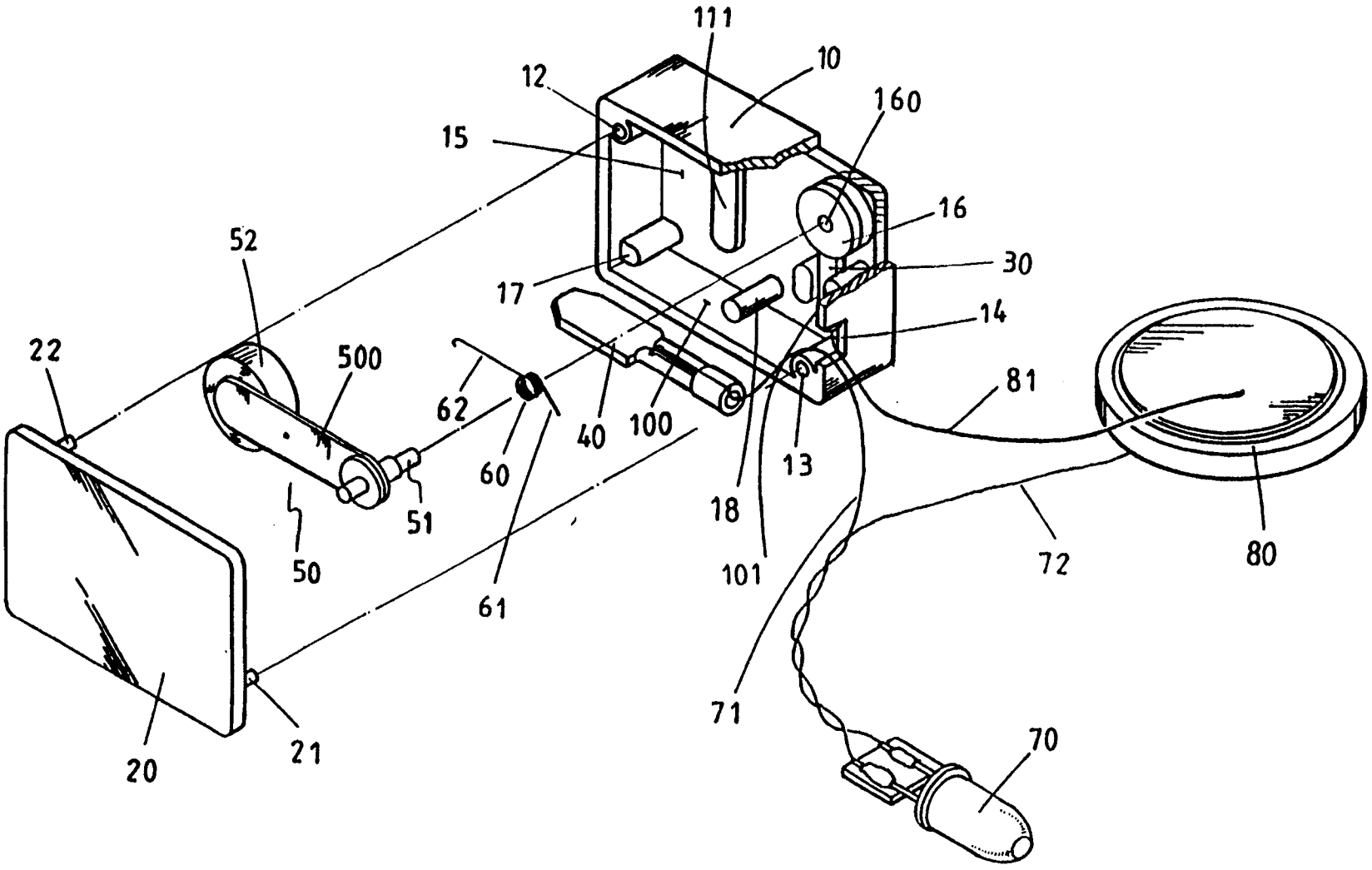
FIG. 1 is an exploded view of a light emitting device according to the preferred embodiment of the present invention.

Referring to FIG. 1, a casing 10 is made to be a suitable size, having an internal space 11 covered by a cover board 20. The cover board 20 includes pins 21 and 22 mounted on diagonal corners of the cover board 20. The pins 21, 22 are inserted into respective pin holes 12 and 13 located on the casing 10. A wire hole 14 is formed on one side of the casing 10 for inserting electric wires. The casing 10 includes a guide 111 projecting over an interior bottom surface 15 of the casing 10 a conductive block 16 spaced from the guide 111, a first metal contact 30 fastened to the conductive block 16, a second metal contact 40 located within a narrow space along an elongated side wall 100 of the casing 10 and two locating posts 17 and 18. A conductive swivel device 50 includes an elongated flat body 500 having a metal pin 51 on one end which is inserted in a center hole 160 formed in the conductive block 16 and disposed in contact with the first metal contact 30. The device 50 also includes a metal counter weight 52 located on an opposite end of the device 50 and slidably supported on the guide 111. A torsional spring 60 is mounted on the pin 51 of the swivel device 50. The spring 60 has one end 61 disposed to abut against a short side wall 101 of the casing 10 and an opposite end 62 hooked on the elongated flat body 500 of the conductive swivel device 50. A light emitting element (for example, a light emitting diode) 70 has one pole connected to the second metal contact 40 by a conductor 71 and an opposite pole connected to one end of an electronic battery cell 80 by a conductor 71. The opposite end of the electronic battery cell 80 is connected to the first metal contact 30 by a conductor 81. The electronic battery cell 80 and the light emitting element 70 are located outside the casing 10. The conductors 71, 81 are respectively inserted through the wire hole 14 and then connected to the metal contacts 40, 30; respectively.

Figure 3:
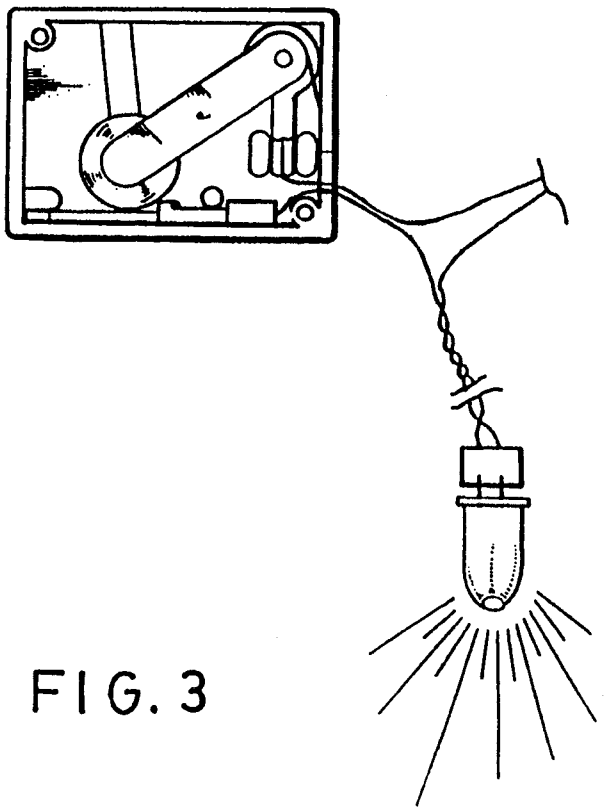
FIG. 3 is another front view of the light emitting device when electrically connected.
Figure 2:
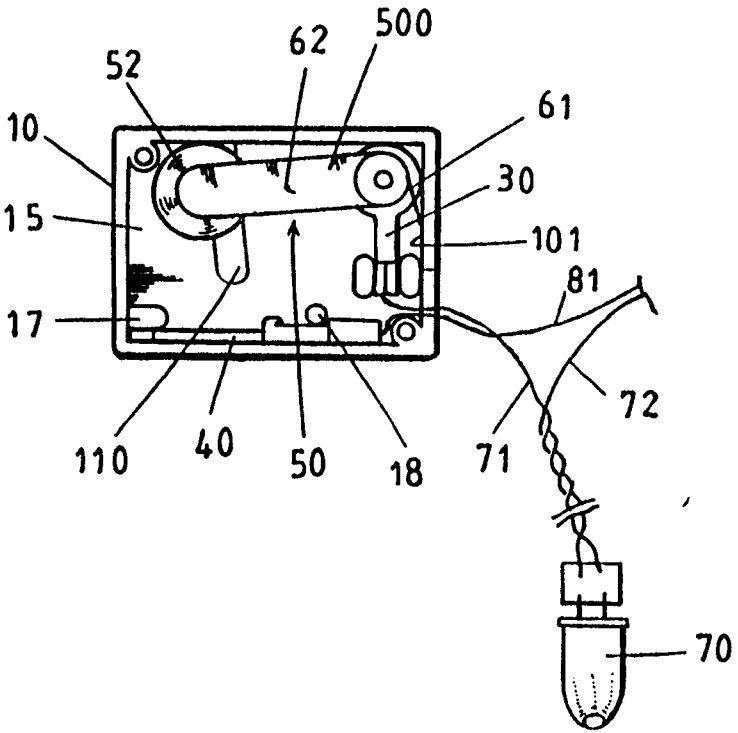
FIG. 2 is a front view of the light emitting device when electrically disconnected.

Referring to FIG. 2, because of the spring force of the torsional spring 60, the metal counter weight 52 of the conductive swivel device 50 is constantly supported on the guide 111 and spaced from the second metal contact 40. Thus, the light emitting element 70 is electrically disconnected and does no work when the casing 10 is immovable. As the light emitting device 70 is moved by an external force, the conductive swivel device 50 will be oscillated back and forth alternatively, causing the metal counter weight 52 to intermittently contact the second metal contact 40 (see FIG. 3). As the metal counter weight 52 contacts the second metal contact 40, the electric circuit is connected, and therefore the light emitting element 70 is turned on to emit light.

Figure 4:
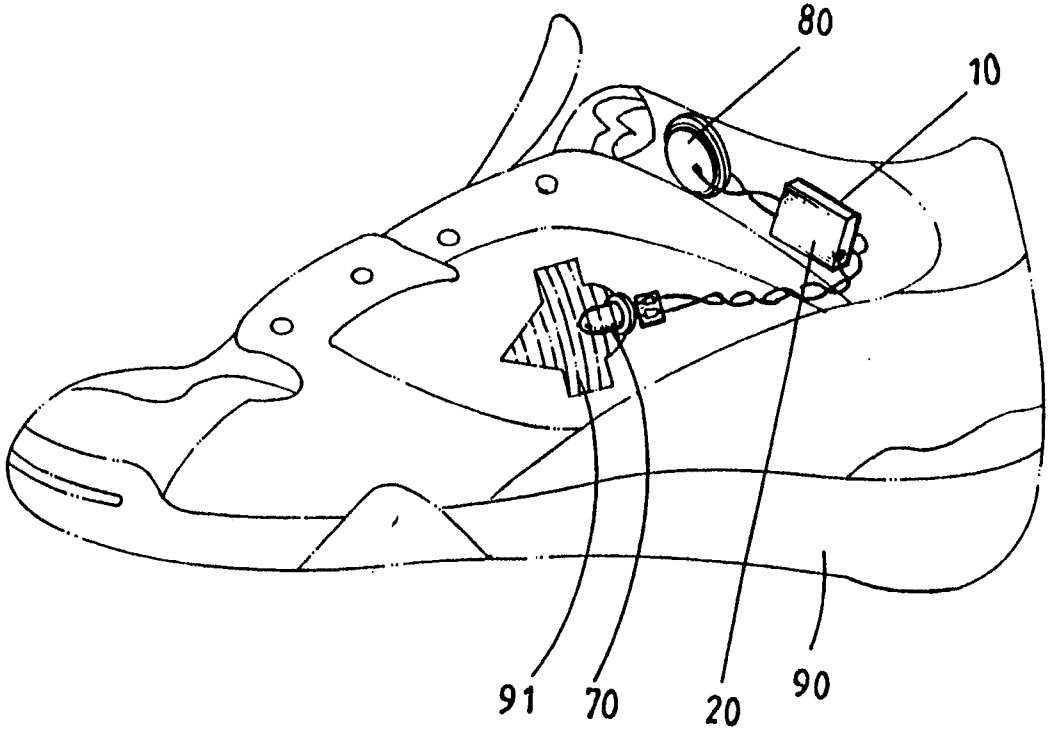
FIG. 4 is an applied view of the present invention showing the light emitting device installed in a sports shoe.
Figure 5:
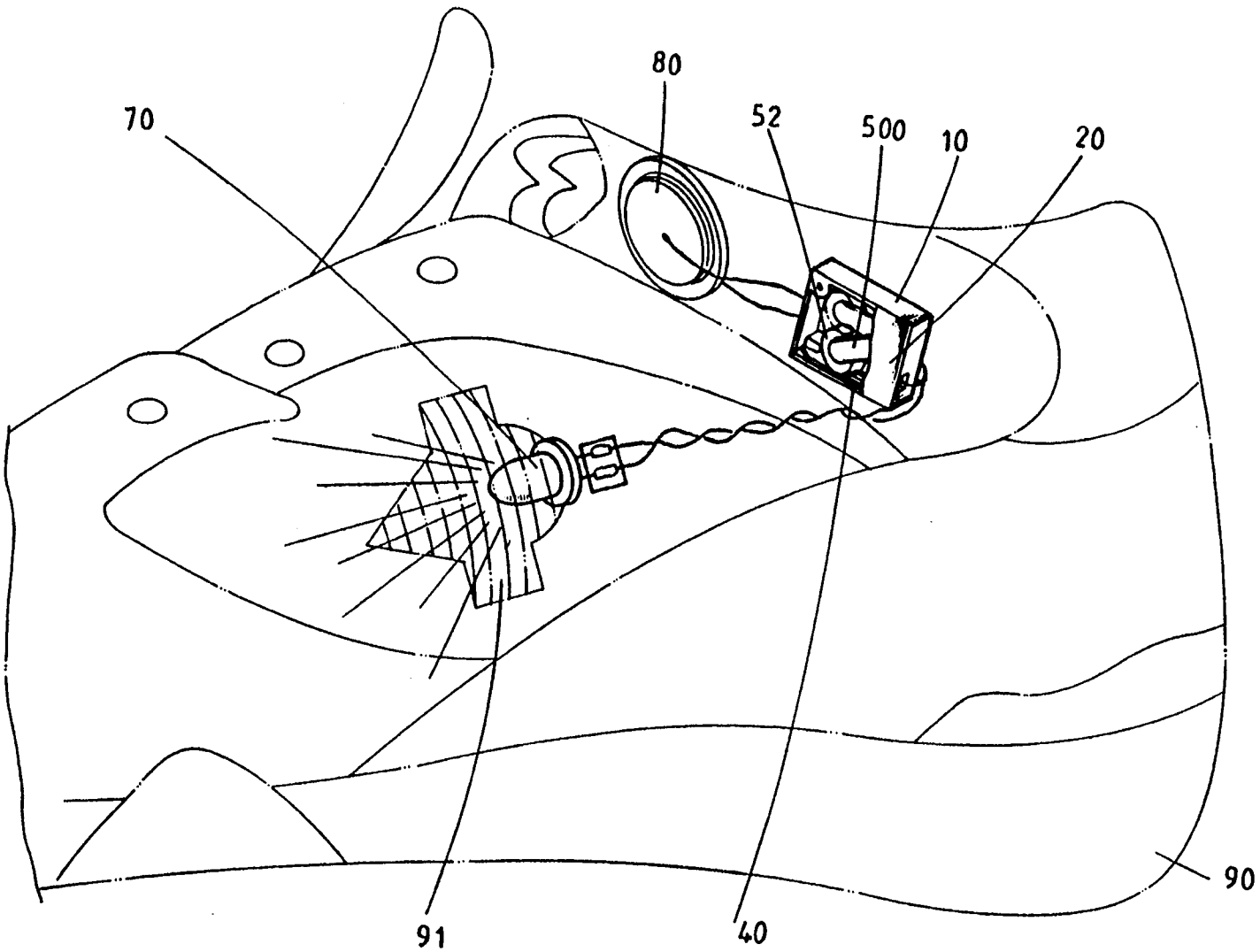
FIG. 5 is a partial view of FIG. 4 in an enlarged scale.

Referring to FIGS. 4 and 5, the casing 10 and the electronic battery cell 80 may be fastened to the vamp of a sports shoe at a suitable location, and the light emitting element 70 may be fastened to the vamp on the outside and protected by a transparent covering 91. As the sports shoe is moving, the swivel device 50 is alternatively oscillated to intermittently connect the circuit, causing the light emitting element 70 to emit light intermittently.

While only one embodiment of the present invention has been shown and described, it will be understood that various modifications and changes could be made without departing from the spirit and scope of the invention.

What is claimed is:

1. A movement-controlled light emitting device comprising:

a) a casing;

b) a cover board for covering the casing;

c) a conductive block mounted in the casing;

d) a first metal contact connected to the conductive block;

e) a second metal contact located in the casing and spaced from the first metal contact;

f) a conductive swivel device including:

1) a swivel body;

2) a swivel pin located on one end of the swivel body and rotatably mounted on the conductive block;

3) a counter weight located on an opposite end of the swivel body;

4) a spring to hold the counter weight away from the second metal contact;

g) a light emitting circuit including:

1) a light emitting element;

2) an electronic battery cell; and 3) two opposite poles respectively connected to the first and second metal contacts; wherein moving the casing causes the counter weight to intermittently contact the second metal contact to intermittently activate the light emitting circuit so that the light emitting element emits light.

2. The movement-controlled light emitting device of claim 1, wherein the spring is a torsional spring mounted on the swivel pin of the conductive swivel device, the spring having a first end abutting against the casing and a second end fastened to the swivel body of the conductive swivel device.

3. The movement-controlled light emitting device of claim 1, further comprising two locating posts mounted in the casing, wherein the second metal contact is confined within a narrow space defined by the two locating posts and the casing.

4. The movement-controlled light emitting device of claim 1, wherein the casing further comprises a bottom wall and a guide projecting over the bottom wall to guide the counter weight along a fixed course.

5. The movement-controlled light emitting device of claim 1, wherein the casing and the light emitting circuit are fastened on an interior portion of a vamp of a shoe and the light emitting element is disposed on an outside portion of the shoe and protected by a transparent covering on the shoe.

* * * * *